US005677054A

United States Patent [19]

Kakiuchi

[11] Patent Number: 5,677,054

[45] Date of Patent: Oct. 14, 1997

[54] WOUND GOLF BALL

[75] Inventor: Shinichi Kakiuchi, Chichibu, Japan

[73] Assignee: Bridgestone Sports Co., Ltd., Tokyo, Japan

[21] Appl. No.: 536,200

[22] Filed: Sep. 29, 1995

[30] Foreign Application Priority Data

Oct. 11, 1994 [JP] Japan ..... 6-271723

[51] Int. Cl.$^6$ ..... B32B 19/00

[52] U.S. Cl. ..... 428/357; 273/245; 428/492; 428/493; 428/497; 428/904.4

[58] Field of Search ..... 428/402, 357, 428/492, 493, 497, 904.4; 273/62, 219, 220, 222, 227, 231, 245

[56] References Cited

U.S. PATENT DOCUMENTS 4,943,332 7/1990 Sakaguchi et al. ..... 156/146
5,387,637 2/1995 Sullivan ..... 524/493
5,397,129 3/1995 Kato et al. ..... 273/227
5,496,034 3/1996 Maruko et al. ..... 273/216
5,518,815 5/1996 Koizumi ..... 428/372

*Primary Examiner*—H. Thi Le
*Attorney, Agent, or Firm*—Sughrue, Mion, Zinn, Macpeak & Seas, PLLC

[57] ABSTRACT

A wound golf ball includes a liquid center consisting of a center bag filled with a liquid, thread rubber wound on the liquid center, and a cover. The center bag is formed of a rubber composition comprising a base rubber, an inorganic filler, and a process oil having a pour point of up to 0° C. The content of the process oil is limited to 5 to 18% by weight of the content of the inorganic filler. The ball is improved in flying distance at low temperature.

3 Claims, No Drawings

WOUND GOLF BALL

BACKGROUND OF THE INVENTION

1. Field of the Invention

This invention relates to a wound golf ball which is improved in flying distance, especially at low temperature.

2. Prior Art

Both professional and amateur golfers favor wound golf balls because they have many advantages including more spin and good feeling as compared with two-piece golf balls. Wound golf balls are generally formed by filling a center bag with a liquid to form a liquid center, winding thread rubber on the liquid center, and enclosing with a cover. The liquid center consists of a center bag of rubber compound filled with a liquid, typically water. In order to further improve various properties of wound golf balls as mentioned above, many improvements have been made on the liquid center. For example, Japanese Patent Publication (JP-B) No. 10957/1993 discloses a liquid center in which the center bag is formed of a rubber composition having naphthenic oil blended therein and the liquid fill includes water and ethylene glycol. JP-B 10958/1993 discloses a liquid center in which the center bag is formed of a rubber composition having naphthenic oil blended therein and the liquid fill includes water, ethylene glycol, and a specific gravity adjusting agent selected from barium sulfate, calcium sulfate, and sodium sulfate. Japanese Patent Application No. 340861/1993 discloses a liquid center in which the center bag has a limited outer diameter, hardness and thickness. Japanese Patent Application No. 126923/1994 discloses a liquid center in which the center bag is filled with a liquid having a limited specific gravity and viscosity. These attempts intend to improve the liquid center as means for enhancing the performance of wound golf balls.

As compared with golf balls having a solid center, the wound golf balls having a liquid center are vulnerable to the ambient temperature. On hitting, a wound golf ball is substantially changed in initial speed and flying distance depending on the ambient temperature at which the ball is struck. This is also true for the wound golf balls having the improved liquid centers discussed above as the previous attempts. A comparison made between the properties of a wound golf ball at two different temperatures, normal temperature and low temperature (e.g., 23° C. and 0° C.) reveals that hitting at the low temperature results in a lower initial speed and a fairly shorter flying distance than at the normal temperature.

SUMMARY OF THE INVENTION

Therefore, an object of the present invention is to provide a wound golf ball which is not substantially reduced in flying distance even when hit at low temperature.

The present invention is directed to a wound golf ball comprising a liquid center consisting of a center bag filled with a liquid, thread rubber wound on the liquid center, and a cover. According to the invention, the center bag is formed of a rubber composition comprising a base rubber, an inorganic filler, and a process oil having a pour point of up to 0° C. The content of the process oil is 5 to 18%, preferably 6 to 15% by weight of the content of the inorganic filler. Then the ball is minimized in reduction of flying distance when hit at low temperature. As compared with wound golf balls having conventional liquid centers, the wound golf ball of the invention affords a satisfactory flying distance during play at low temperature as in winter.

As described in JP-B 10957/1993 and 10958/1993, it is known to blend naphthenic oil and zinc white (or filler) in a rubber composition of which the center bag is made. The known rubber compositions contain relatively large amounts of naphthenic oil relative to zinc white, for example, naphthenic oil being blended in an amount of about 20% by weight based on the amount of zinc white. If the amount of naphthenic oil relative to zinc white is as large as this exemplary value, the ball experiences a substantial loss of flying distance at low temperature as will be later described in Comparative Example. In contrast, if the amount of process oil relative to filler is reduced to less than 20% by weight, namely 5 to 18% by weight, quite unexpectedly, the reduction of flying distance which the ball would otherwise encounter when hit at low temperature is significantly suppressed.

DETAILED DESCRIPTION OF THE INVENTION

According to the present invention, an inorganic filler and a process oil having a pour point of not higher than 0° C. are blended in a rubber composition of which a center bag is formed. The center bag is filled with a liquid to form a liquid center, which is enclosed with a thread rubber layer and a cover to complete the wound golf ball.

The process oil used herein has a pour point of not higher than 0° C., preferably between −10° C. and −40° C. The pour point of process oil affects the initial speed of the resultant wound golf ball. The use of a process oil having a pour point of not higher than 0° C. prevents the golf ball from substantially reducing its initial speed when hit at low temperature as in winter. If a process oil having a pour point of higher than 0° C. is used, the golf ball offers a substantially reduced initial speed when hit at low temperature. Any of process oils may be used as long as their pour point is 0° C. or lower. Commercially available naphthenic oils are useful.

In the center bag-forming rubber composition, the inorganic filler is blended as well as the process oil. The inorganic filler is effective, when combined with a proper amount of process oil, for imparting desirable strength, specific gravity and durability to the center bag made of the rubber composition. The inorganic filler may be selected from those fillers which are commonly added to conventional center bag-forming rubber compositions. Exemplary useful fillers are zinc white, barium sulfate, calcium carbonate, and silica, with the zinc white being preferred. The content of the inorganic filler in the rubber composition may be properly determined without undue experimentation.

While the inorganic filler and the process oil are blended in a rubber composition, the content of the process oil should be 5 to 18% by weight, preferably 6 to 15% by weight of the content of the inorganic filler. If the proportion of process oil relative to inorganic filler is less than 5% by weight, the resulting center bag has a higher hardness so that the ball might receive more spin and fly a shorter distance. If the proportion of process oil relative to inorganic filler is more than 18% by weight, the resulting center bag has a lower strength, resulting in a ball being reduced in initial speed and flying distance at low temperature. Outside the range of 5 to 18%, the object of the invention cannot be attained.

The base rubber includes natural rubber, butadiene rubber, isoprene rubber, and mixtures thereof. In addition to the base rubber, process oil and inorganic filler, the center bag-forming rubber composition may further contain conventional additives, for example, a vulcanizing agent such as sulfur, a vulcanization promoter, and stearic acid. A process oil having a pour point of higher than 0° C. may also be blended as long as the object of the invention is not deterred.

In forming a center bag from the above-mentioned rubber composition, adjustment is preferably made such that the center bag may have a specific gravity of 1.0 to 3.0, more preferably 1.5 to 2.5. If the center bag has a specific gravity of more than 3.0, the center bag must have a thinner gage than the conventionally used gage value in order that the golf ball have a weight within the standard. When a center bag of such reduced gage is filled with a known liquid, the center bag can be ruptured, failing to contain the liquid. The gage of the center bag is preferably 1.5 mm or more from the standpoint of strength and 3.0 mm or less from the standpoint of spin, especially between 1.8 mm and 2.5 mm.

The center bag is filled with a liquid to form a liquid center. The fill liquid may be selected from known liquids which are used in conventional wound golf ball liquid centers. Water is most useful. The fill liquid may have a specific gravity of 1.0 to 3.0. Fine powder, specific gravity modifiers and surfactants may be added to water to achieve such a specific gravity. Exemplary specific gravity modifiers include barium sulfate ($BaSO_4$), calcium sulfate ($CaSO_4$) and sodium sulfate ($Na_4SO_4$).

Any desired well-known technique may be used to fill the center bag with the liquid. For example, the rubber composition is molded and vulcanized to form a pair of hemispherical halves, which are joined together to form a hollow center bag. Using a syringe, a predetermined amount of fill liquid is admitted into the center bag to form a liquid center. In another procedure, a pair of hemispherical halves are joined in fill liquid and taken out of the liquid. Alternatively, fill liquid is frozen in a spherical form, around which a pair of hemispherical halves are joined. The liquid center prepared by any of these procedures should preferably have an outer diameter of 27 to 32 mm and a weight of 15 to 24 g.

The type of thread rubber wound on the liquid center and the winding technique may be conventional. The liquid center is wrapped with thread rubber to form a wound core preferably having a diameter of 38 to 41 mm.

The cover enclosing the wound core may be formed of conventional compositions used in prior art wound golf balls. More particularly, the cover may be formed of a composition comprising a well-known cover resin such as ionomer resins and balata rubber and conventional amounts of optional additives including pigments such as titanium white and dispersants such as magnesium stearate. The cover may be either a single layer or a multi-layer cover. Its thickness varies with cover forming conditions and may be properly selected.

Typically the cover is prepared by placing the wound core in a mold cavity and injection molding a cover-forming resin composition. Alternatively, half shells are preformed from a cover-forming resin composition and compression molded over the wound core.

The wound golf ball of the invention has a size and weight meeting the Golf Association Standards, that is, a diameter of at least 42.67 mm and a weight of up to 45.92 g.

There has been described a wound golf ball wherein the center bag is formed of a rubber composition having blended therein an inorganic filler and a limited amount of a process oil with a pour point of up to 0° C. whereby the ball is not substantially reduced in initial speed even when hit at low temperature, that is, the ball flies a good distance even in winter season.

EXAMPLE

Examples of the present invention are given below by way of illustration and not by way of limitation.

Examples 1–4 and Comparative Examples 1–6

A liquid center was prepared by molding a rubber composition as shown in Table 1 in a hemispherical mold cavity and vulcanizing it to form hollow hemispherical shells having a thickness of 2.3 mm, a hardness on JIS A scale and a specific gravity as reported in Table 1. The fill liquid used was either (A) water or (B) 20% sodium sulfate aqueous solution. A pair of shells were bonded in the fill liquid, completing a liquid center in the form of a center bag full of the liquid.

Thread rubber (Crum thread rubber) was wound on the liquid center by a conventional winding technique to form a core ball consisting of the liquid center and thread rubber layer and having a diameter of 40 mm. The core ball was enclosed with a pair of half shells pre-formed from the following balata rubber composition.

| Balata cover composition | Parts by weight |
|---|---|
| Trans-1,4-polyisoprene | 60 |
| Hi-styrene resin | 20 |
| Natural rubber | 20 |
| Zinc oxide | 10 |
| Titanium oxide | 10 |
| Stearic acid | 1.0 |
| Sulfur | 1.5 |

The balata shells were heated and compression molded around the core at about 85° C. for 10 minutes to form a ball having a diameter of 42.7 mm. The ball was subject to dip vulcanization for 48 hours, completing a wound golf ball. The cover layer of the resulting wound golf ball was about 1.6 mm thick. The wound golf ball was examined for various properties by the following tests. The results are shown in Table 2.

Ball Hardness

A distortion (mm) of a ball under a load of 100 kg was measured.

Hit at 23° C. and 0 C.

Using a hitting machine, a ball was hit at 23° C. and 0° C. by a driver W#1 at a head speed of 45 m/s.

TABLE 1

| | Example | | | | Comparative Example | | | | | |
|---|---|---|---|---|---|---|---|---|---|---|
| | 1 | 2 | 3 | 4 | 1 | 2 | 3 | 4 | 5 | 6 |
| Center bag | | | | | | | | | | |
| Rubber composition (pbw) | | | | | | | | | | |
| Natural rubber | 100 | 100 | 100 | 100 | 100 | 100 | 100 | 100 | 100 | 100 |
| Process oil-1 | 30 | 30 | 25 | 25 | — | — | — | — | 40 | 10 |
| Process oil-2 | — | — | — | — | 30 | 20 | 12 | 20 | — | — |
| Zinc white | 340 | 230 | 260 | 180 | 330 | 320 | 200 | 255 | 200 | 300 |

TABLE 1-continued

| | Example | | | | Comparative Example | | | | | |
|---|---|---|---|---|---|---|---|---|---|---|
| | 1 | 2 | 3 | 4 | 1 | 2 | 3 | 4 | 5 | 6 |
| Stearic acid | 1.0 | 1.0 | 1.0 | 1.0 | 1.0 | 1.0 | 1.0 | 1.0 | 1.0 | 1.0 |
| Vulcanization promoter | 1.5 | 1.5 | 1.5 | 1.5 | 1.5 | 1.5 | 1.5 | 1.5 | 1.5 | 1.5 |
| Sulfur | 2.5 | 2.5 | 2.5 | 2.5 | 2.5 | 2.5 | 2.5 | 2.5 | 2.5 | 2.5 |
| Process oil/filler (wt %) | 8.8 | 13.0 | 9.6 | 13.9 | 9.1 | 6.3 | 6.0 | 7.8 | 20.0 | 3.3 |
| Physical properties as vulcanized | | | | | | | | | | |
| Hardness (JIS-A) | 61 | 54 | 56 | 52 | 61 | 62 | 61 | 61 | 51 | 65 |
| Specific gravity | 2.32 | 1.95 | 2.11 | 1.82 | 2.33 | 2.36 | 1.96 | 2.14 | 1.81 | 2.36 |
| Fill liquid | | | | | | | | | | |
| Type | A | B | A | B | A | A | B | A | B | A |
| Specific gravity | 1.00 | 1.18 | 1.00 | 1.18 | 1.00 | 1.00 | 1.18 | 1.00 | 1.18 | 1.00 |
| Liquid center | | | | | | | | | | |
| Outer diameter (mm) | 28.0 | 28.0 | 29.0 | 29.0 | 28.0 | 28.0 | 28.0 | 29.0 | 29.0 | 28.0 |
| Weight (g) | 16.7 | 16.4 | 17.9 | 18.0 | 16.8 | 16.9 | 16.5 | 18.1 | 17.8 | 16.9 |
| Wound ball | | | | | | | | | | |
| Outer diameter (mm) | 45.4 | 45.1 | 45.2 | 45.3 | 45.4 | 45.5 | 45.1 | 45.3 | 45.0 | 45.4 |
| Weight (g) | 42.68 | 42.68 | 42.69 | 42.68 | 42.68 | 42.68 | 42.69 | 42.69 | 42.67 | 42.67 |
| Hardness (mm) | 2.80 | 2.81 | 2.81 | 2.82 | 2.80 | 2.80 | 2.82 | 2.81 | 2.81 | 2.80 |

Note:
Process oil-1: Mitsubishi 20 Lite Process Oil pour point: −32.5° C.
Process oil-2: Dyna Process Oil AH-58 pour point: 10.0° C.
Fill liquid: A = water, B = 20% sodium sulfate solution

TABLE 2

| | Example | | | | Comparative Example | | | | | |
|---|---|---|---|---|---|---|---|---|---|---|
| | 1 | 2 | 3 | 4 | 1 | 2 | 3 | 4 | 5 | 6 |
| Hit at 23° C. | | | | | | | | | | |
| Initial velocity (m/s) | 65.3 | 65.5 | 65.4 | 65.5 | 65.3 | 65.3 | 65.4 | 65.4 | 65.3 | 65.2 |
| Spin (rpm) | 3000 | 2890 | 2900 | 2760 | 2950 | 3000 | 2980 | 2900 | 2750 | 3320 |
| Elevation angle (°) | 12.0 | 11.9 | 11.9 | 11.9 | 12.0 | 12.1 | 12.0 | 12.0 | 11.9 | 12.2 |
| Carry (m) | 203.0 | 204.7 | 204.3 | 205.5 | 203.1 | 203.2 | 203.3 | 204.5 | 205.5 | 203.2 |
| Total (m) | 216.5 | 218.2 | 218.5 | 219.3 | 216.7 | 216.1 | 216.5 | 218.4 | 219.0 | 214.6 |
| Hit at 0° C. | | | | | | | | | | |
| Initial velocity (m/s) | 62.6 | 62.7 | 62.6 | 62.8 | 62.2 | 62.1 | 62.2 | 62.3 | 62.3 | 62.5 |
| Spin (rpm) | 2700 | 2620 | 2610 | 2550 | 2680 | 2720 | 2700 | 2600 | 2500 | 2910 |
| Elevation angle (°) | 10.1 | 10.0 | 10.0 | 10.0 | 9.9 | 9.9 | 10.0 | 9.9 | 9.8 | 10.2 |
| Carry (m) | 189.8 | 189.3 | 189.1 | 188.9 | 187.1 | 197.0 | 197.2 | 187.6 | 197.1 | 188.3 |
| Total (m) | 204.6 | 206.2 | 205.5 | 206.5 | 202.0 | 201.8 | 202.1 | 203.0 | 202.8 | 201.9 |
| ΔV | 2.7 | 2.8 | 2.8 | 2.7 | 3.1 | 3.2 | 3.2 | 3.1 | 3.0 | 2.7 |

Note: ΔV is the initial velocity at 23° C. minus the initial velocity at 0° C.

It is evident from Table 2 that the wound golf balls of Examples 1 to 4 within the scope of the invention experience a less reduction of initial velocity at the low temperature of 0° C. and offer a satisfactory flying distance inclusive of carry and total, as compared with the wound golf balls of Comparative Examples 1–4 using a process oil with a high pour point, Comparative Example 5 using a process oil with a low pour point, but in a too larger amount, and Comparative Example 6 using a process oil with a low pour point, but in a too smaller amount.

Japanese Patent Application No. 271723/1994 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

I claim:

1. A wound golf ball comprising a liquid center consisting of a center bag of a rubber composition filled with a liquid, thread rubber wound on the liquid center, and a cover, wherein the rubber composition comprises a base rubber, an inorganic filler, and a process oil having a pour point of up to 0° C., the content of the process oil being 5 to 18% by weight of the content of the inorganic filler.

2. The wound golf ball of claim 1 wherein the center bag has a specific gravity of 1.0 to 3.0.

3. The wound golf ball of claim 1, wherein the content of the process oil being 6 to 15% by weight of the inorganic filler.

* * * * *